US010889016B2

(12) United States Patent
Davos et al.

(10) Patent No.: US 10,889,016 B2
(45) Date of Patent: Jan. 12, 2021

(54) ROTARY RAZOR

(71) Applicant: Bic Violex S.A., Anixi (GR)

(72) Inventors: Vasileios Davos, Ilion (GR); Georgios Koulourias, Attica (GR)

(73) Assignee: BIC VIOLEX S.A., Anoixi (GR)

( * ) Notice: Subject to any disclaimer, the term of this patent is extended or adjusted under 35 U.S.C. 154(b) by 0 days.

(21) Appl. No.: 16/269,302

(22) Filed: Feb. 6, 2019

(65) Prior Publication Data

US 2019/0240852 A1 Aug. 8, 2019

(30) Foreign Application Priority Data

Feb. 8, 2018 (EP) ..... 18155782

(51) Int. Cl.

| | |
|---|---|
| ***B26B 19/28*** | (2006.01) |
| ***B26B 21/40*** | (2006.01) |
| ***B26B 21/56*** | (2006.01) |
| ***B26B 19/14*** | (2006.01) |
| ***B26B 21/34*** | (2006.01) |
| ***B26B 19/40*** | (2006.01) |
| ***B26B 19/16*** | (2006.01) |
| ***B26B 21/48*** | (2006.01) |

(52) U.S. Cl.

CPC ..... *B26B 19/282* (2013.01); *B26B 19/14* (2013.01); *B26B 19/16* (2013.01); *B26B 19/40* (2013.01); *B26B 21/34* (2013.01); *B26B 21/4018* (2013.01); *B26B 21/48* (2013.01); *B26B 21/565* (2013.01)

(58) Field of Classification Search

CPC ..... B26B 19/14; B26B 19/143; B26B 19/146; B26B 19/148; B26B 19/16; B26B 19/28; B26B 19/282; B26B 19/284; B26B 19/286; B26B 19/40; B26B 21/4018; B26B 21/565; B26B 21/34; B26B 21/48

See application file for complete search history.

(56) References Cited

U.S. PATENT DOCUMENTS

| | | | | |
|---|---|---|---|---|
| 616,554 A | | 12/1898 | O'Rourke | |
| 1,519,504 A | | 12/1924 | Pando | |
| 1,543,387 A | | 6/1925 | Kawalle | |
| 1,981,202 A | * | 11/1934 | Shipman | B26B 19/18 30/41.6 |

(Continued)

FOREIGN PATENT DOCUMENTS

| | | |
|---|---|---|
| DE | 20 2004 002 937 U1 | 8/2005 |
| EP | 1 707 326 A1 | 10/2006 |

(Continued)

OTHER PUBLICATIONS

Extended European Search Report dated Nov. 23, 2018, in European Application No. 18155782.8.

*Primary Examiner* — Evan H MacFarlane

(74) *Attorney, Agent, or Firm* — Bookoff McAndrews, PLLC

(57) ABSTRACT

A wet shaving device comprising a motor; an actuator configured to vary the speed of the motor; a rotary blade module having at least one cutting element; and a drive train assembly including at least one shaft operatively coupling the motor and the rotary blade module, wherein the at least one shaft may be configured to transfer the rotational movement of the motor to the rotary blade module.

15 Claims, 4 Drawing Sheets

(56) References Cited

U.S. PATENT DOCUMENTS

| | | | | | |
|---|---|---|---|---|---|
| 2,216,673 | A | * | 10/1940 | McGall | B26B 19/16 30/41.6 |
| 2,440,061 | A | | 4/1948 | Page | |
| 2,795,042 | A | | 6/1957 | Ritchey et al. | |
| 3,245,145 | A | | 4/1966 | Buford | |
| 3,359,634 | A | | 12/1967 | Beck | |
| 4,031,618 | A | | 6/1977 | Mansfield | |
| 4,043,036 | A | | 8/1977 | Stevens, Sr. et al. | |
| 4,979,297 | A | * | 12/1990 | Bertram | B26B 19/14 30/34.1 |
| 5,014,428 | A | * | 5/1991 | Yamashita | B26B 19/16 30/43 |
| 5,022,154 | A | * | 6/1991 | Johnson | B26B 19/18 30/34.05 |
| 5,313,704 | A | * | 5/1994 | Atsumi | B26B 19/28 30/43.6 |
| 5,687,481 | A | * | 11/1997 | De Boer | B26B 19/14 30/43.1 |
| 8,033,022 | B2 | | 10/2011 | Ben-Ari | |
| 8,601,696 | B2 | | 12/2013 | Ben-Ari | |
| 8,928,747 | B2 | | 1/2015 | Burdoucci | |
| 9,174,351 | B2 | | 11/2015 | Binder | |
| 9,862,107 | B2 | | 1/2018 | Perlberg et al. | |
| 2008/0060202 | A1 | * | 3/2008 | Oh | B26B 19/16 30/43.6 |
| 2011/0173816 | A1 | | 7/2011 | Ben-Ari | |
| 2013/0091709 | A1 | * | 4/2013 | Shimizu | B26B 19/063 30/47 |
| 2014/0130642 | A1 | * | 5/2014 | Rodriguez | B26B 19/28 83/13 |
| 2014/0137883 | A1 | | 5/2014 | Rothschild | |
| 2015/0174773 | A1 | | 6/2015 | Hodgson | |
| 2015/0197019 | A1 | | 7/2015 | Hodgson et al. | |
| 2015/0197020 | A1 | | 7/2015 | Hodgson et al. | |
| 2016/0250762 | A1 | * | 9/2016 | Eljaouhari | B26B 19/14 83/13 |
| 2016/0271816 | A1 | | 9/2016 | Xu et al. | |

FOREIGN PATENT DOCUMENTS

| | | | |
|---|---|---|---|
| EP | 1 900 487 | A1 | 3/2008 |
| FR | 2 716 402 | A1 | 8/1995 |
| WO | 2005/107373 | A2 | 11/2005 |
| WO | 2014/191844 | A2 | 12/2014 |

* cited by examiner

ROTARY RAZOR

CROSS REFERENCE TO RELATED APPLICATION(S)

This application claims priority to European Patent Application No. 18155782.8, filed Feb. 8, 2018, the entire content of which is incorporated herein by reference.

FIELD

The inventive concept relates to a servo-driven mechanism for rotating a rotary blade module continuously. Such a shaving system may include a means for supplying a shaving aid or lubricant that is delivered prior to or during shaving.

BACKGROUND

Electric shavers have been produced for many years, dating back to 1898, as archived by U.S. Pat. No. 616,554 which is directed to an automatic razor in which the cutting motion of the blade is produced by a motor. Since then, electric shavers have been further developed to be lighter, more precise, wireless, and water resistant.

For example, US patent application number 2011/173816 discloses a shaving apparatus in which the drive mechanism, that may be in the form of an electric motor, is positioned within a rotary cutter, and hairs are sheared between the cutting edges of the rotary cutter and a fixed blade in a scissor-like action during a shaving operation. As a result of positioning the drive mechanism within the rotary cutter, the head of the apparatus achieves a compact construction.

EP patent application publication number 1 707 326 discloses an electric razor with one or more exposed-blade rotating rollers employing a filament wound in a helical configuration around the rollers. In the field of manual razors, it was known to employ metal wires stretched across the blades in the direction of travel to provide safety blade protection. However, the wire wrapping around the blades tended to cause a "shadow", i.e., leave tracks along the paths traveled by the wires where the blades did not have access to the hairs. As a result of a filament wound in a helical configuration around the rollers, the occurrence of "shadows" was avoided.

US patent application number 2016/0271816 discloses a replaceable fluid dispensing cartridge for a liquid dispensing razor having a fluid interconnect member with a pivotable support member. A result of this configuration is that the fluid dispensing cartridge is replaceable and fluid (e.g., shaving aid) can be administered during shaving.

SUMMARY

The present inventors have recognized that it is desirable to control the speed of the rotary blade while shaving, in particular during a wet shave, to accommodate different skin types and areas of the body, as well as administer shaving aid prior to or during shaving.

According to embodiments of the present disclosure, a wet shaving device is provided. The shaving device may comprise a motor; an actuator configured to vary the speed of the motor; a rotary blade module having at least one cutting element; and a drive train assembly including at least one shaft operatively coupling the motor and the rotary blade module, wherein the at least one shaft may be configured to transfer the rotational movement of the motor to the rotary blade module.

In this configuration, the motor of the shaving device may be positioned away from the rotary blade module (e.g., in the handle) while also continuously driving the rotary blade module. Positioning the motor away from the rotary blade module allows the shaving device to have a slimmer profile and a superior weight distribution in comparison with shaving devices that have the motor proximate to the rotary blade module.

According to some embodiments, when the actuator is in a first position, the rotary blade module may rotate at a first speed, and when the actuator is in a second position, the rotary blade module may rotate at a second speed that is different from the first speed.

In this configuration, the rotary blade module can operate at varying speeds. This is beneficial because the different speeds can accommodate different hair types and skin types (e.g., coarse hair to fine hair, or sensitive skin). For example, a user with coarse hair may desire to operate the rotary blade module at a fast speed to increase the number of times the razors on the rotary blade module contacts their hair. However, a user with sensitive skin may desire to operate the rotary blade module at a slow speed to decrease the number of times the razors on the rotary blade module contacts their hair in order to decrease skin irritation.

According to some embodiments, the motor may be configured to rotate about a first axis and rotary blade module may be configured to rotate about a third axis that is substantially perpendicular to the first axis.

In this configuration, the motor of the shaving device may be positioned away from the rotary blade module (e.g., in the handle) while also continuously driving the rotary blade module. Additionally, adapting the rotary blade module to rotate on an axis that is substantially perpendicular to the axis that the motor rotates allows the motor to easily be incorporated into the handle of the shaving device and disposes the motor in an orientation that allows for the handle to have a slim profile.

According to some embodiments, the drive train assembly may comprise a first shaft, second shaft, and third shaft.

According to some embodiments, the motor may be configured to cause the first shaft to rotate about a first axis, the second shaft to rotate about a second axis and a third shaft to rotate about a third axis. Additionally, the first, second, and third axes may not be co-linear.

Incorporating multiple shafts in the drive train assembly aids in allowing the motor of the shaving device to be positioned away from the rotary blade module (e.g., in the handle) while also continuously driving the rotary blade module, and additionally allows for the handle to have a slim profile.

According to some embodiments, a second end of the first shaft may include a bevel gear.

Adapting the first shaft to have a bevel gear permits the rotary blade module to rotate on an axis that is substantially perpendicular to the axis that the motor rotates, which allows the motor to easily be incorporated into the handle of the shaving device and disposes the motor in an orientation that allows for the handle to have a slim profile.

According to some embodiments, the third shaft may be sealingly connected to the rotary blade module.

Sealingly connecting the third shaft to the rotary blade handle allows the rotary blade module to receive a lubricant inside of the body of the rotary blade module, if the rotary blade module is constructed to have a hollow body. Additionally, connecting the third shaft to the rotary blade module allows the rotational movement of the motor to be transferred to the rotary blade module.

According to some embodiments, the shaving device may further include a razor housing and handle. The drive train assembly may be disposed inside of the handle and the rotary blade module may be disposed inside of the razor housing.

In this configuration, the motor of the shaving device may be positioned away from the rotary blade module (e.g., in the handle) while also continuously driving the rotary blade module. Positioning the motor away from the rotary blade module allows the shaving device to have a slimmer profile and a superior weight distribution in comparison with shaving devices that have the motor proximate to the rotary blade module.

According to some embodiments, the rotary blade module may be configured to rotate independently of the housing.

The rotary blade module can be disposed within the housing, which does not rotate and can be adapted to include a foil. This configuration protects the user from having a rotating element in direct contact with their skin that could cause skin irritation.

According to some embodiments, the rotary blade module may have at least two cutting elements and a lubricant delivery means interposed therebetween.

Including a lubricant delivery means between the blades allows for lubricant or shaving aid to be administered to the user during or prior to a wet shaving operation. The shaving aid helps in the shaving experience by increasing the glideness during shaving and reducing friction on a user's skin, which reduces skin irritation.

According to some embodiments, the rotary blade module may have a hollow body and may define at least one hole interposed between the at least two cutting elements.

According to some embodiments, an interior of the hollow body of the rotary blade module may be configured to receive a lubricant.

In this configuration, the rotary blade module is lighter and can receive lubricant therein. This reduces the time a user spends on shaving preparation because they do not need to independently apply shaving aid using a separate shaving aid means (e.g., an aerosol canister of shaving gel).

According to some embodiments, the lubricant delivery means may be at least one elongated bar having at least one hole, where the elongated bar may be interposed between the at least two cutting elements and over the at least one hole of the rotor blade module, such that the interior of the hollow body is in fluid communication with an exterior of the hollow body.

Including the elongated bar having at least one hole and positioned over the at least one hole of the rotary blade module, channels the shaving aid from inside the rotary blade module closer to the surface of a user's skin during a shaving operation.

According to some embodiments, the shaving device may further include a piston at least partially disposed in the hollow body of the rotary blade module, the piston may be configured to pump lubricant through the at least one hole of the at least one elongated bar.

Including a piston that is configured to pump lubricant through the rotary blade module and elongated bars helps ensure a consistent delivery of lubricant to a user's skin.

According to some embodiments, the lubricant delivery means may comprise a strip having an anti-friction coating on at least a portion thereof.

Including a lubricant delivery means between the blades allows for lubricant or shaving aid to be administered to the user during or prior to a shaving operation. The shaving aid helps in the shaving experience by increasing the glideness during shaving and reducing friction on a user's skin, which may reduce skin irritation.

DESCRIPTION OF THE EMBODIMENTS

Reference will now be made in detail to exemplary embodiments of the disclosure, examples of which are illustrated in the accompanying drawings. Wherever possible, the same reference numbers will be used throughout the drawings to refer to the same or like parts.

Figure 1A:
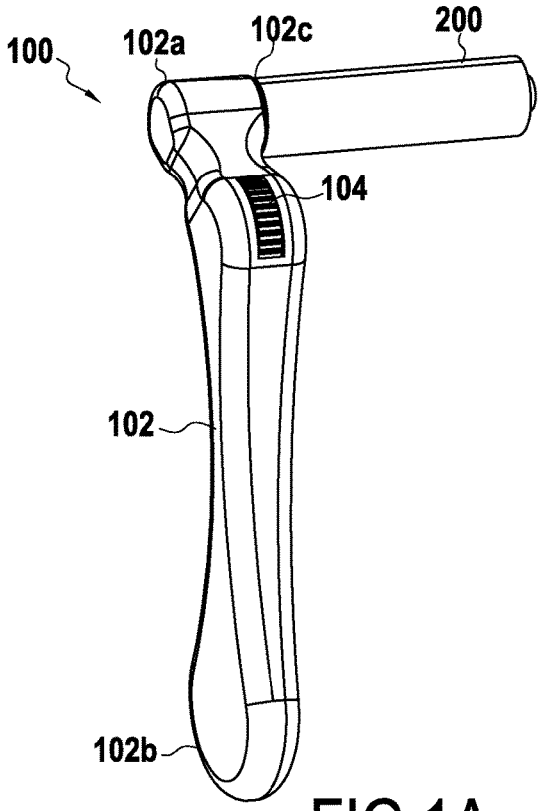
FIG. 1A shows a perspective view of an exemplary shaving device.
Figure 1B:
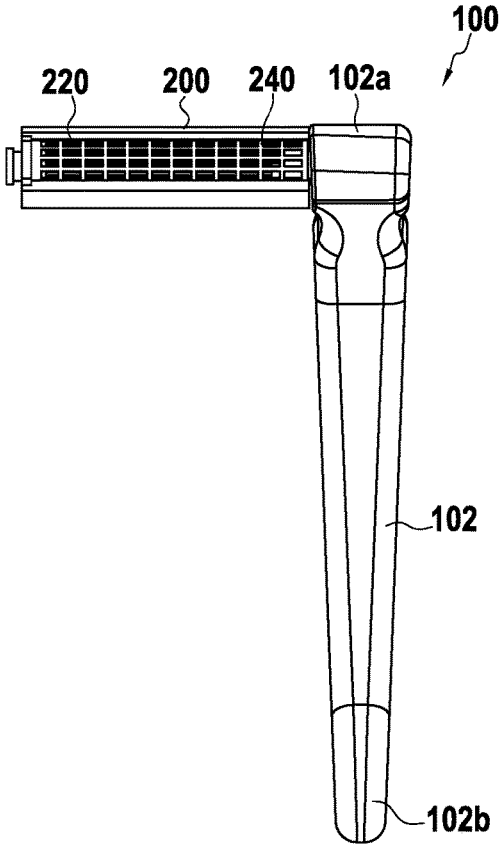
FIG. 1B shows a front view of the exemplary shaving device.

FIGS. 1A and 1B show an exemplary shaving device 100 that may be used as a wet shaver. The shaving device 100 has a handle 102 having an upper portion 102*a*, a lower portion 102*b*, and an attachment portion 102*c*; an actuator 104; and a rotary razor cartridge 200, which includes a movable rotary blade module 240.

The rotary razor cartridge 200 is connected to the upper portion 102*a* of the handle 102 via the attachment portion 102*c*. The rotary razor cartridge 200 may be fixedly attached to the handle 102; however, it is envisioned that the rotary razor cartridge may be disposable and detachable from the handle 102. The handle 102 may be hollow on the interior and adapted to encase a drive train assembly 110, 112, 114, which is discussed in detail with reference to FIG. 2A. The handle 102 may be angled to accommodate the natural contours of a hand; however, the handle 102 may be any other shape suitable for encasing the drive train assembly 110, 112, 114. Additionally, the handle 102 may be fabricated from a polymer, metal, or composite or any combination thereof.

Figure 2A:
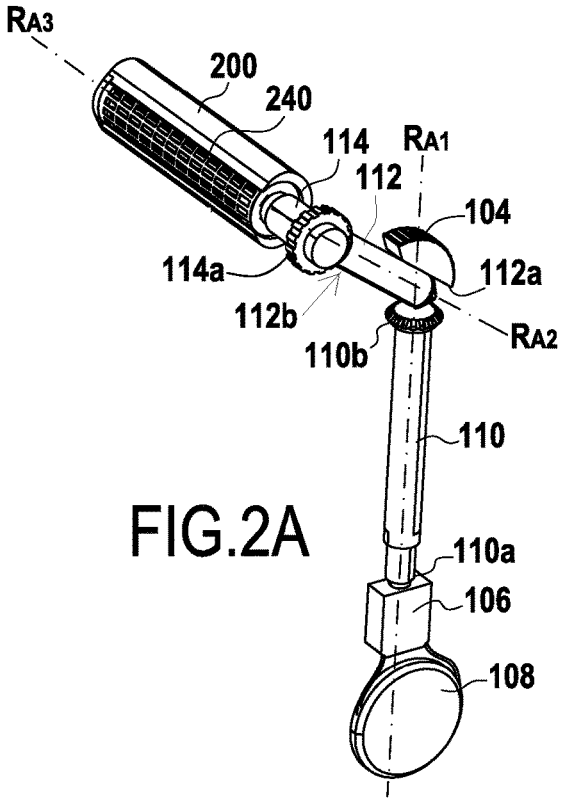
FIG. 2A shows the exemplary shaving device without the handle.

The actuator 104 may be partially disposed on the outer surface of the handle 102 and electrically connected to a variable speed motor 106 disposed inside the handle 102 (shown in FIG. 2A). The actuator may be a switch, toggle, or slide and controls a rotation speed of the rotary blade module 240 of the rotary razor cartridge 200. With the variable speed function, a user may have the possibility to choose the rotation speed depending on their skin type or the area to be shaved, for example.

Additionally, the actuator 104 is configured to rotate the rotary blade module 240 a first speed when at a first position, and the actuator 104 is configured to rotate the rotary blade module 240 at a second speed when at a second position, the second speed being different from the first speed. For example, the rotary blade module 240 may rotate at 30 rpm when the actuator is in the first position, and rotate at 120 rpm when the actuator is in the second position.

FIG. 2A shows a drive train assembly 110, 112, 114 that may be used to transfer the rotation of the motor 106 to the rotary blade module 240. The drive train assembly 110, 112, 114 components may be encased within the handle 102 as well as the motor 106, and a power source 108 (for example, a battery). The power source 108 may be connected to the motor 106 with electrical connectors (e.g., wires) and disposed in the lower portion of the handle 102*b*.

The motor 106 may be connected to a first end 110*a* of a first shaft 110 in the lower portion 102*b* of the handle 102. The first shaft 110 extends through the handle 102 into the upper portion 102*a* thereof. The first shaft 110 has a second end 110*b*, which may comprise a bevel gear.

The second end 110*b* of the first shaft 110 may be operably connected to (e.g., meshed) with a first end 112*a* of a second shaft 112. The first end 112*a* of the second shaft 112 may also comprise a bevel gear, for example. The second shaft 112 may extend away from the first shaft 110 and has a second end 112*b* that may comprise a helical gear, for example.

The second end 112*b* of the second shaft 112 may be meshed with a first end 114*a* of a third shaft 114. The first end 114*a* of the third shaft 114 also may comprise a helical gear, for example.

Figure 2B:
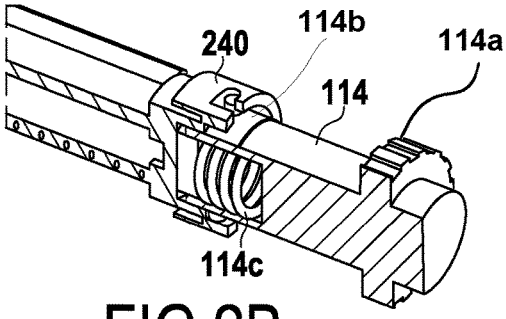
FIG. 2B shows a cross-section of a bayonet mounting.

The third shaft 114 may extend substantially perpendicular to the second shaft 112 and has a second end 114*b* (shown in FIG. 2B). The second end 114*b* of the third shaft 114 may be adapted to sealingly engage the rotary blade module 240, via, for example, a snap-fit connection or a bayonet mounting, as shown in FIG. 2B. In this bayonet mounting, a spring 114*c* may be disposed at least partially within the third shaft 114 and adapted to apply a pressure between the third shaft 114 and the rotary blade module 240, thereby holding the bayonet connection into place and ensuring that the third shaft 114 sealingly engages the rotary blade module 240.

In operation, when a user manipulates the actuator 104 to power the motor 106, the motor 106 rotates and causes the first shaft 110 to rotate about a first axis $R_{A1}$. Through the action of the meshed bevel gears of the first and second shafts 110, 112, the rotational movement of the first shaft 110 is transmitted to the second shaft 112 which causes the second shaft 112 to rotate about a second axis $R_{A2}$. Then, through the action of the meshed helical gears of the second and third shafts 112, 114, the rotational movement of the second shaft 112 is transmitted to the third shaft 114, causing the third shaft 114 to rotate about a third axis $R_{A3}$.

The rotational movement of the third shaft 114 is transferred to the rotatory blade module 240, thereby causing the rotatory blade module 240 to rotate about the third rotational axis $R_{A3}$. The configuration of this drive train assembly 110, 112, 114 results in the continuous rotational motion of the rotatory blade module 240, thereby providing a continuous cut. In operation, rotational speed of the rotor blade module 240 may range between approximately 30-120 rpm.

It is contemplated that other types of gear systems may be implemented that allow for the transfer of rotational movement between the motor 106 and rotatory blade module 240, and thus should not be limited to the example described herein.

Figure 3:
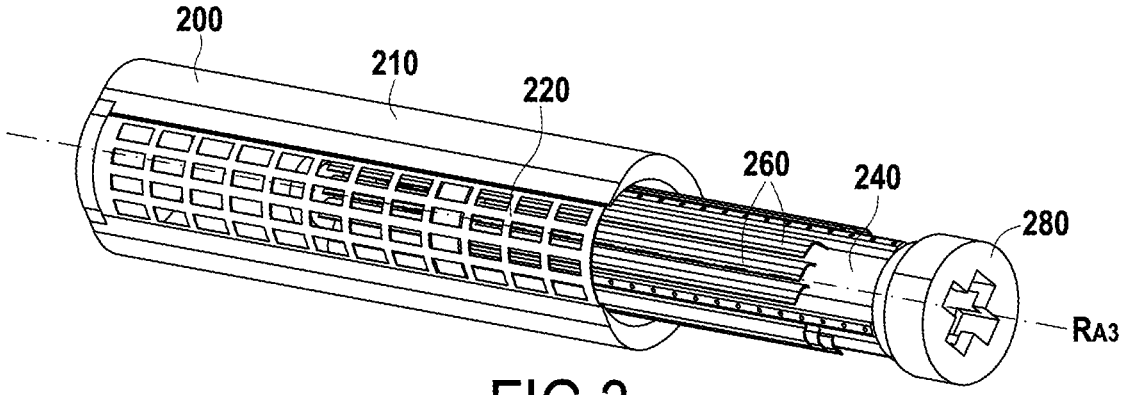
FIG. 3 shows a perspective view of a rotary razor cartridge of the exemplary shaving device.
Figure 4:
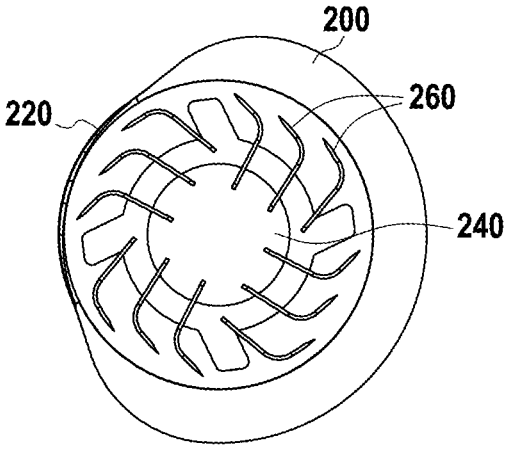
FIG. 4 shows a side view of the rotary razor cartridge of the exemplary shaving device.

FIGS. 3 and 4 show a rotary razor cartridge 200 which may include a housing 210, a rotary blade module 240 having cutting elements 260 or blades thereon. The rotary razor cartridge 200 is shown having a plurality of blades 260 that are disposed evenly about an outer circumference of the rotary blade module 240, however the number of blades and how they are disposed on the rotary blade module 240 may vary. Blades 260 are also depicted as bent, however any type of blade may be used, for example, movable blades with support or fixedly spaced blades.

The blades 260 fit into respective slots formed on the outer surface of the rotary blade module 240, ensuring their stability during the rotational motion of the rotary blade module 240. Additionally, the blades may be kept in their position during the rotational movement of the rotary blade module 240 with the aid of the side ends 280 of the rotary blade module 240, which may also serve as blade retainers. The means for fixing of the blades 260 can be of any type, for example, fixed by welding the blades on the rotary blade module 240 or fixing the blade to the rotary blade module 240 via resilient movable members.

The rotary razor cartridge 200 may further include a foil 220, which may be a thin layer of metal comprising a plurality of orifices that partially cover the blades 260. The foil 220 may be fixed to the housing 210, thus being independent of the rotational movement of the rotary blade module 240. The foil 220 ensures safety during any cutting operation, as well as eliminates any nicks and cuts, enhances glideness, and contributes to the overall improvement of the shaving performance. Further, the foil 220 may be coated with hydrophilic coating to enhance gliding.

Figure 5:
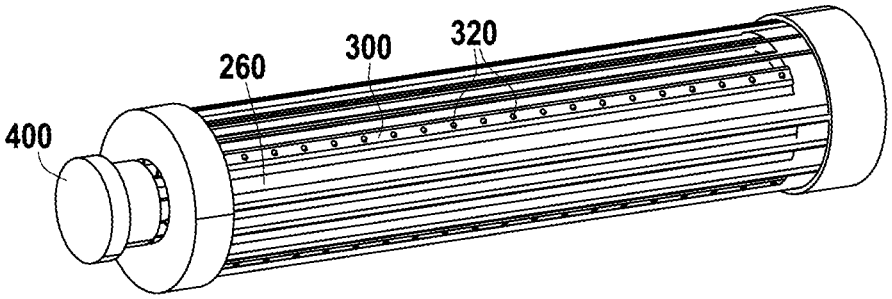
FIG. 5 shows a perspective view of a rotary blade module of the exemplary shaving device.
Figure 6:
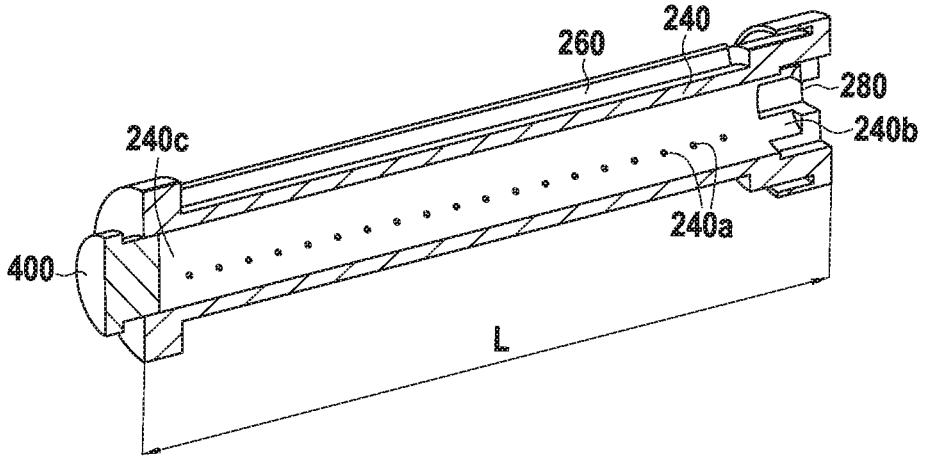
FIG. 6 shows a cross-section of the rotary blade module of the exemplary shaving device.

FIGS. 5 and 6 show the rotor blade module 240 having a lubricant delivery means 300, 400. The rotor blade module 240 may be hollow and may have a plurality of holes 240*a* that are evenly distributed in a line spanning a length L of the rotor blade module 240. The holes 240*a* are adapted to allow fluid communication between the inner surface and exterior surface of the rotor blade module 240. The rotor blade module 240 may have any number of holes 240*a* distributed in any manner. Additionally, the holes 240*a* can be of any size or shape.

The rotor blade module 240 may further have first and second openings 240*b*, 240*c* on each end of the rotor blade module 240. The first opening 240*b* may be adapted to sealingly connect with the second end 114*b* of the third shaft 114. The second opening 240*c* may be adapted to sealingly connect with a piston 400 that is configured to pump lubricant.

The rotor blade module 240 may also have elongated bars 300 disposed on the outer circumferential surface thereof. The elongated bars 300 may be interposed between proximate blades 260 and cover at least some of the holes 240*a*. The illustrative embodiment depicts a plurality of elongated bars 300; however the rotor blade module 240 may have any number thereon. The elongated bars 300 may be attached to the rotor blade module 240 by welding, or any other suitable means.

The elongated bars 300 may have a plurality of holes 320 spanning along its length, where the holes 320 are adapted to allow fluid communication between the inner and exterior surfaces of the rotor blade module 240. The elongated bars 300 may have any number of holes 320 distributed in any manner, for example, 20 holes that are higher in density toward the center of the bar. Additionally, the holes 320 can be of any size or shape. As shown in the exemplary embodiment, the elongated bars 300 may be positioned to cover a line of holes 240*a* spanning the length L of the rotor blade module 240.

The interior of the hollow rotor blade module 240 may receive lubricant or shaving aid, and thus may be used as a reservoir. The lubricant may be any type of shaving aid, including but not limited to: water, soap, foam, or gel.

The piston 400 may be adapted to pump lubricant and/or shaving aid through the holes 240*a* of the rotary blade module 240 and, subsequently, holes 320 of the elongated bars 300, so that lubricant can be delivered to a user. This may be done prior to or during a wet shaving operation. Additionally, the piston 400 may be activated either simultaneously with the actuator 104, for example, by having a single switch, or independently by providing second switch that is configured to operate only the piston 400. The piston 400 may be a piston pump, or any other suitable means to aid in delivering lubricant to the user.

It is also envisioned, that the handle 102 may have a reservoir adapted to contain lubricant or shaving aid which may be delivered to the user prior to or during the shaving operation. The additional reservoir may be in lieu of the reservoir of the rotary blade module 240 or in combination therewith.

Figure 7:
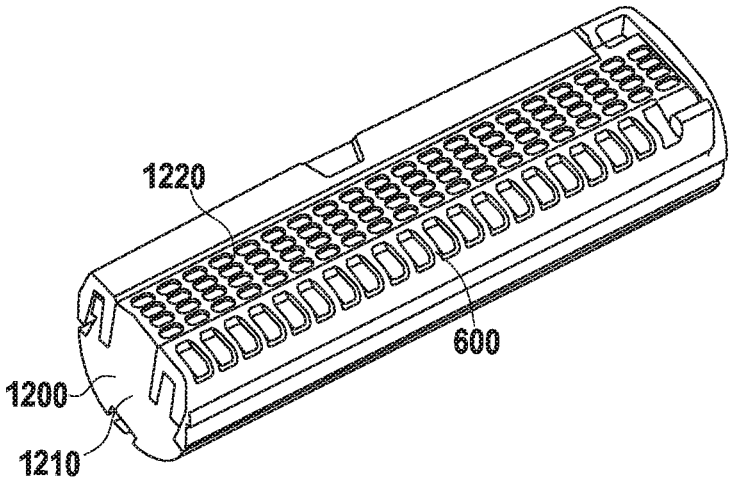
FIG. 7 shows a perspective view of an alternative rotary blade module of the exemplary shaving device.

FIG. 7 shows the rotor razor cartridge 1200 having a comb guard 600 attached thereto. The housing 1210, on which the foil 1220 and the comb guard 600 is mounted, does not rotate, but is removably connected to the handle 102. This can be achieved by, for example, forming a protrusion on the housing 1210 and forming a corresponding recess on the handle 102. The comb guard 600 may be detachably connected to the housing 1210 of the rotor razor cartridge 1200.

The comb guard 600 may comprise a plurality of grooves or recesses and may be located adjacent to the foil 1220, such that when the shaving device 100 is used, the plurality of grooves or recesses are adapted to prepare (e.g., lift) the hair prior to it being cut during a shaving operation. Alternatively, or in combination with the plurality of grooves, the comb guard 600 may comprise a plurality of teeth which also are adapted to prepare the hair during a shaving operation. The plurality of the teeth of the comb guard 600 may have different heights and/or thicknesses. This detachable comb 600 may be used for trimming depending on user needs. The height of the teeth may be comprised between 1 mm and 20 mm, preferably between 2 mm and 10 mm and/or preferably between 10 mm and 15 mm. The number of the teeth may be comprised between 5 and 15.

It is contemplated that the housing 1210 of the rotor razor cartridge 1200 may also comprise a shaving aid (lubrication strip, antifriction coating, etc.) and/or a guard bar, for example, rubber fins on the surface thereof. It is intended that combinations of the above-described elements and those within the specification may be made, except where otherwise contradictory.

Although the present disclosure herein has been described with reference to particular embodiments, it is to be understood that these embodiments are merely illustrative of the principles and applications of the present disclosure.

For example, in addition to the embodiments above, the rotary razor cartridge 1200 may further comprise at least one electric resistance element (not shown) adapted to provide heat to at least one of the cutting elements, e.g., blades 260. Suitable approaches for applying heat resistance may be found in US20150197019, US2015197020, and/or US2015174773 which are herein incorporated by reference.

Further, it is also envisioned that the rotary razor cartridge 1200 may further comprise an imaging device (not shown) operable to capture images of the skin being shaved by the rotary razor to evaluate the quality of the shaving operation. This may be achieved by using, for example, a camera. Suitable approaches for adapting such an imaging device onto the rotary razor cartridge 1200 may be found in US 20140137883, U.S. Pat. No. 9,174,351, and/or U.S. Pat. No. 8,928,747 which are herein incorporated by reference.

Figure 8:
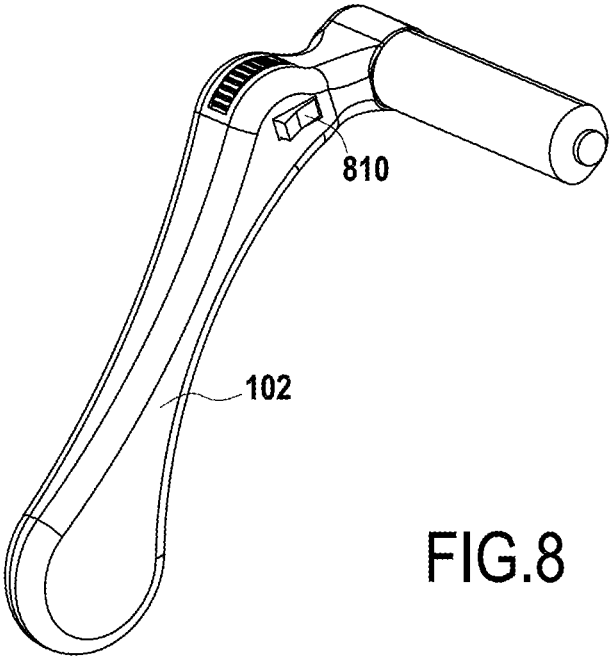
FIG. 8 shows an exemplary implementation of a temperature control system for a rotary razor according to embodiments of the present disclosure.
Figure 9:
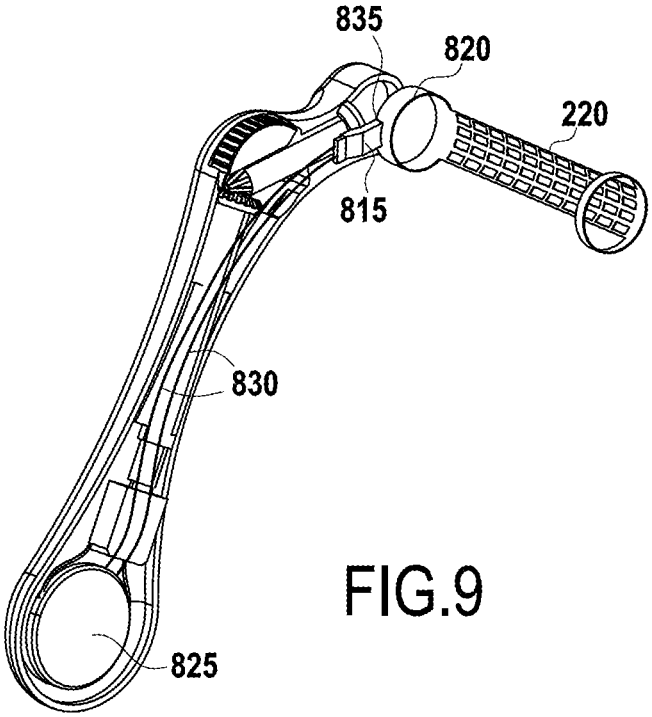
FIG. 9 shows an exemplary user interface for the temperature control system of FIG. 8.

According to yet further embodiments, the shaving device 100 may be operable to heat or cool the foil 220. FIGS. 8 and 9 highlight such an exemplary embodiment. Heat transfer to and/or from foil 220 may be achieved by, for example, another power source (for example a battery), a custom peltier module 815, a link 835, and a ring 820 mounted on a side end of the foil 220 and a hot-cold actuator 810 mounted, for example, on the handle 102.

In detail, another power source 825 (e.g., a battery) may be provided, for example, within handle 102. The power source 825 may be connected to the custom peltier module 815 with electrical connectors 830 (e.g. wires), with hot-cold actuator 810 interposed there between to permit selection of a heating or cooling operation of custom peltier module 815.

The custom peltier module 815 may be operably coupled with the link 835 and the ring 820 mounted on a side end of the foil 220 to transfer (e.g., by conduction) heat to and/or from foil 220, thereby resulting in a heating or cooling effect for the user when contacting the foil 220.

The custom peltier module 815 may be operable to heat the foil 220 up to, for example, 65° C. A desired maximum cooling temperature for a razor in a preferred embodiment may be in the range between 10° C. to 20° C. With the hot-cold actuator, a user may have the possibility to choose the effects to be transferred to his skin (cooling or heating) depending on his desires, thus improving the overall shaving experience.

The accompanying drawings, which are incorporated in and constitute a part of this specification, illustrate embodiments of the disclosure and together with the description, and serve to explain the principles thereof.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

It is intended that the specification and examples be considered as exemplary only, with a true scope of the disclosure being indicated by the following claims.

The invention claimed is:

1. A wet shaving device comprising:

a handle extending generally along a first axis;

a motor configured to be rotated about the first axis, the motor being disposed in the handle;

an actuator configured to vary a speed of the motor;

a rotary blade module having at least one cutting element, the rotary blade module configured to rotate about a third axis that is substantially perpendicular to the first axis;

a razor housing extending away from the handle and generally along the third axis, wherein the rotary blade module is disposed within the razor housing; and a drive train assembly including at least one shaft operatively coupling the motor and the rotary blade module, wherein the at least one shaft is configured to transfer a rotational movement of the motor to the rotary blade module, wherein the at least one shaft of the drive train assembly includes a first shaft, a second shaft connected to the first shaft, and a third shaft connected to the second shaft, the first shaft includes a first end and a second end, the first end is connected to the motor and the second end includes a bevel gear to facilitate connection to a first end of the second shaft and rotation of the first shaft with respect to the second shaft, the second shaft being connected to a first end of the third shaft and the third shaft including a second end that is sealingly connected to the rotary blade module.

2. The wet shaving device according to claim 1, wherein, when the actuator is in a first position, the rotary blade module rotates at a first speed, and when the actuator is in a second position, the rotary blade module rotates at a second speed that is different from the first speed.

3. The wet shaving device according to claim 1, wherein the motor is configured to facilitate rotation of the first shaft about the first axis, rotation of the second shaft about a second axis, and rotation of the third shaft about the third axis, wherein the first axis, the second axis, and the third axis are not co-linear, and wherein the second axis and the third axis are substantially perpendicular to one another.

4. The wet shaving device according to claim 1, wherein the handle extends from a first end to a second end, wherein the razor housing extends from the second end of the handle, in a direction away from the first end of the handle.

5. The wet shaving device according claim 1, wherein the second end of the third shaft is sealingly connected to the rotary blade module by a bayonet mounting, wherein the wet shaving device further includes a spring that is at least partially disposed within the third shaft, wherein the spring is configured to apply a pressure between the third shaft and the rotary blade module to secure the third shaft to the rotary blade module.

6. The wet shaving device according to claim 1, wherein the razor housing is connected to the handle.

7. The wet shaving device according to claim 1, wherein the drive train assembly is disposed inside of the handle, and the at least one cutting element includes at least two cutting elements.

8. The wet shaving device according to claim 7, wherein the rotary blade module is configured to rotate independently of the razor housing.

9. The wet shaving device according to claim 7, further including a foil member connected to the razor housing and a heat transfer mechanism;

the foil member being positioned to partially cover the at least one cutting element, and the heat transfer mechanism being operable to transfer heat to and/or from the foil member to a surface of a user.

10. The wet shaving device according to claim 1, wherein the at least one cutting element includes at least two cutting elements, and the wet shaving device includes a lubricant delivery device interposed between the at least two cutting elements.

11. The wet shaving device according to claim 10, wherein the rotary blade module includes a hollow body and defines at least one hole interposed between the at least two cutting elements.

12. The wet shaving device according to claim 11, wherein an interior of the hollow body of the rotary blade module is configured to receive a lubricant.

13. The wet shaving device according to claim 12, wherein the lubricant delivery device is at least one elongated bar having at least one hole, wherein the elongated bar is interposed between the at least two cutting elements and over the at least one hole of the rotor blade module, such that the interior of the hollow body is in fluid communication with an exterior of the hollow body.

14. The wet shaving device according to claim 13, further including a piston at least partially disposed in the hollow body of the rotary blade module, the piston being configured to pump the lubricant through the at least one hole of the at least one elongated bar.

15. The wet shaving device according to claim 10, wherein the lubricant delivery device includes a strip having an anti-friction coating on at least a portion thereof.

* * * * *